United States Patent [19]

Gabriel et al.

[11] 4,426,161

[45] Jan. 17, 1984

[54] TURBINE DISC CAVITY TEMPERATURE SENSING ARRANGEMENT

[75] Inventors: Frank K. Gabriel, Springfield Township, Delaware County; William E. North, Concord Township, Franklin County, both of Pa.

[73] Assignee: Westinghouse Electric Corp., Pittsburgh, Pa.

[21] Appl. No.: 333,545

[22] Filed: Dec. 22, 1981

[51] Int. Cl.[3] ..... G01K 1/14; G01N 25/00

[52] U.S. Cl. ..... 374/144; 374/4; 374/138

[58] Field of Search ..... 374/144, 4, 5, 138

[56] References Cited

U.S. PATENT DOCUMENTS

| | | | |
|---|---|---|---|
| 1,653,213 | 12/1927 | Kates | 374/144 X |
| 2,741,919 | 4/1956 | Gaubatz | 374/144 |
| 3,167,960 | 2/1965 | Miesiak | 374/144 X |
| 3,348,414 | 10/1967 | Waters | 374/144 X |
| 3,453,151 | 7/1969 | Fox | 374/4 X |
| 3,788,143 | 1/1974 | Gabriel | 374/144 |
| 3,911,747 | 10/1975 | Sivyer | 136/230 X |
| 4,132,114 | 1/1979 | Shah et al. | 374/144 X |

*Primary Examiner*—Daniel M. Yasich

*Attorney, Agent, or Firm*—E. C. Arenz

[57] ABSTRACT

An arrangement for sensing temperature in an interstage cavity 24 comprises an extractable temperature probe 44 having a radially inner end sensing portion 46 disposed in a bore 40 in a seal housing 22, the bore 40 receiving bypassing fluid flow which enters the bypassing passage 34 from a location intermediate the axial extent of a sealed leakage path 32 between the upstream and downstream regions 24*a* and 24*b,* respectively, of the interstage cavity. These components collectively form the self-aspirating disc cavity seal temperature measuring system.

7 Claims, 1 Drawing Figure

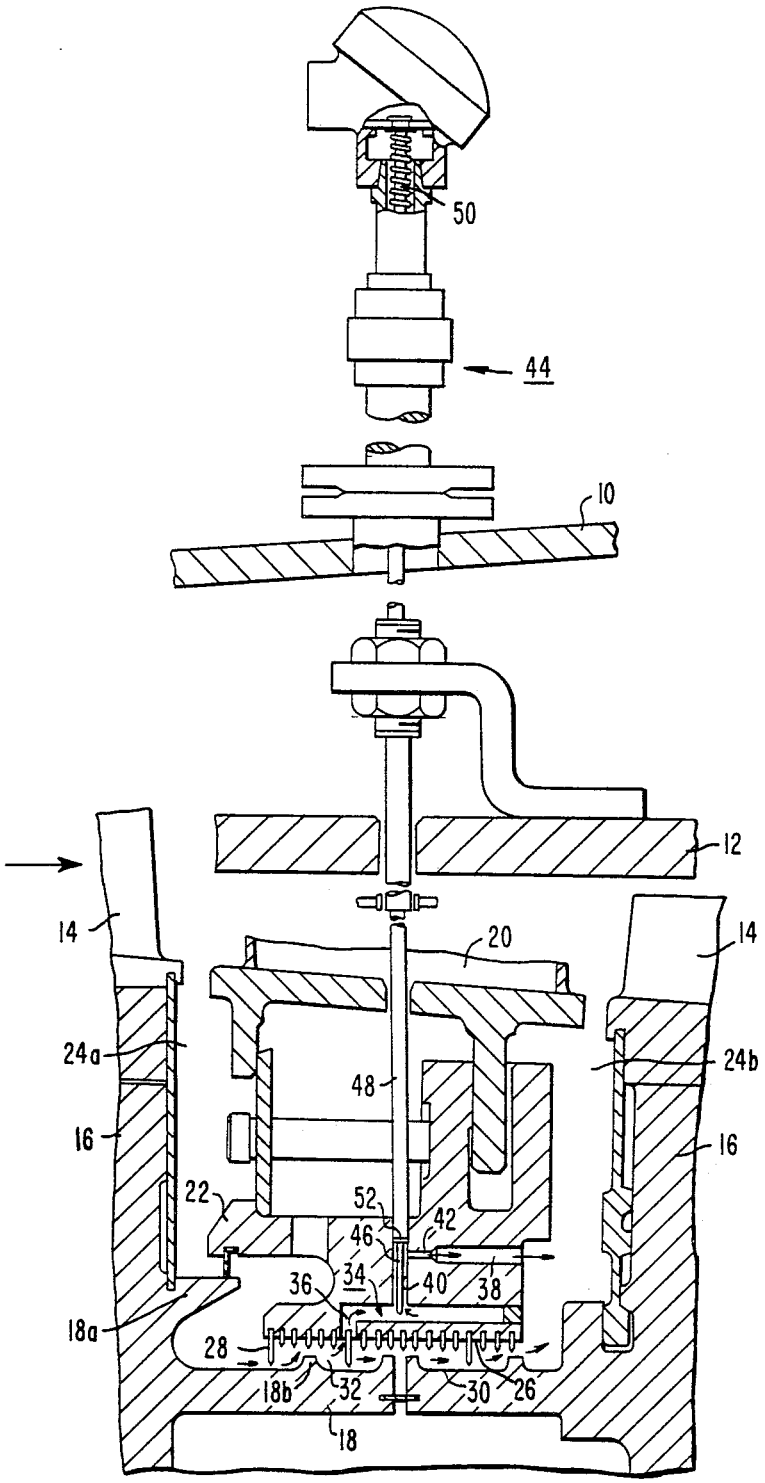
50
44
10
12
14
14
20
24a
24b
48
16
16
22
52
42
46
34
36
40
38
18a
28
18b
32
30
26
18

TURBINE DISC CAVITY TEMPERATURE SENSING ARRANGEMENT

BACKGROUND OF THE INVENTION

1. Field of the Invention

This invention pertains to the art of temperature sensing in turbines, and in particular to temperature sensing in an interstage cavity.

2. Description of the Prior Art

Temperature sensing at various locations in gas turbines is disclosed in the following U.S. Pat. Nos.: 2,741,919; 3,167,960; 3,348,414; and 3,788,143. Of the various locations at which temperatures are sensed in the turbine, only the last noted patent is concerned with temperature sensing of the interstage cavity of a turbine. As that patent correctly states, one of the most critical components of the gas turbine is the rotor disc which is exposed to high centrifugal stresses and high temperatures and, accordingly, it is advantageous to have a continuous indication of the temperature of the metal forming the rotor disc. That patent is thus concerned with the provision of apparatus for sensing the interstage cavity fluid temperature which reflects the disc metal temperature. In that patent the temperature probe assembly includes a flexible end portion which steers the temperature sensing element into one of the so-called seal regions defined between the downstream side of a seal housing structure and the facing rotor disc.

An arrangement according to our invention serves a different requirement in that whereas the reference patent is concerned with measuring the temperature in that part of the cavity through which the gaseous coolant passes to cool the downstream disc, with the present invention the temperature measured is indicative of the environment surrounding elements which will have temperatures more closely reflecting the rotor disc metal temperatures.

SUMMARY OF THE INVENTION

In accordance with our invention, a temperature probe assembly having a straight line configuration is provided with a temperature sensing element at its inner end which is disposed in a radially directed bore in the seal housing structure and through which fluid is bypassed from an intermediate location along a leakage path formed between the seal housing structure and the facing rotor, the leakage path being provided with seal means which limits the leakage therethrough and with a small proportion of the leakage being bypassed past the sensing element and to the downstream region of the interstage cavity.

DRAWING DESCRIPTION

The single FIGURE is a partly-broken, partly-sectioned view of a part of a gas turbine having a single interstage cavity, and provided with a temperature sensing arrangement according to the invention.

DESCRIPTION OF THE PREFERRED EMBODIMENT

While the invention will be described in connection with a typical gas turbine, it will be appreciated that it may be used in steam turbines or other similar structures which have environmental conditions which would make the invention useful therein.

Since the major parts illustrated are typical of gas turbines for purposes of this invention, these major parts will only be generally described since their relation to other parts and operation are well known to those of ordinary skill in the art.

A turbine outer cylinder or casing 10 encompasses a blade ring 12 and associated structure (not shown) and from which, in a radially inner direction, is situated the rotor blades 14 in an annular array at the peripheries of the rotor discs 16 which are fastened together at an intermediate point to form a part of the rotor 18. The stator vanes 20 are also disposed in an annular array radially inwardly of the blade ring 12, with the inner ring of the stator vanes being in generally sealing relation with what is herein called the seal housing structure 22, which is disposed in the interstage cavity defined between the two rotor discs 16. The direction of flow through the turbine is as indicated by the directional arrow to the left of the Figure so that the region **24*a* is the upstream region of the cavity and that of 24*b*** is the downstream region of the cavity.

As is typical with gas turbines of the type to which the invention is applicable, the radially inner face 26 of the seal housing structure 22 is provided with seal means such as the labyrinth seal 28 projecting toward the facing radially outer face 30 of the rotor 18. Thus the seal in the leakage path 32, defined between the facing parts, limits the degree that fluid flows from the higher pressure upstream region **24*a* in the interstage cavity to the lower pressure downstream region 24*b*** of the interstage cavity.

Now, in accordance with the concept underlying our invention, while measuring the fluid temperature in the upstream or downstream regions **24*a* or 24*b* will reflect the metal rotor disc temperature reasonably, these regions are also subject to stratification of the fluid caused by localized hot and cool flows in the complex flow arrangement. It is our view that a considerably more accurate sensing of temperature reflecting the metal rotor temperature is obtainable from the flow in the leakage path 32 because of the mixing of the flow by rotation of the rotor and the further mixing of the flow by a throttling effect as the fluid passes through the leakage path and by the labyrinth seal. The temperature of the flow in this circuit including the leakage path 32 will be affected in its flow by the disc seal land 18*b* and the disc seal arms 18*a*** so that the temperature of the gaseous coolant measured will be indicative of the environment surrounding these parts.

Thus, in accordance with our invention, the housing seal structure is provided with a venting passage generally designated 34 which has an upstream end 36 at an intermediate location along the leakage path and a downstream end 38 open to the downstream region **34*b* of the interstage cavity. The venting passage comprises a number of interconnecting bores in the seal housing structure and includes one of which is a radially directed bore 40 and which, near its radially outer end, is in communication through a reduced diameter aspirating orifice 42 with the downstream end of the passage. It is into this radially directed bore 40 that the one end 46 of the probe assembly 44 provided with the temperature sensing element is disposed. In the case of commercial structures in which this invention is to be embodied, the temperature sensing elment comprises a thermocouple enclosed within the relatively small diameter tube, also designated 46**.

The probe assembly generally designated 44 comprises a series of concentric tubular elements which function as shields for the thermocouple wire, and provide a straight line configuration to facilitate accurate placement of the inner end 46 with the probe extending from exteriorly of the turbine and radially inwardly into the turbine with the end 46 in the radially directed bore 40. The reduced diameter end tube 46 of the assembly is preferably connected in a conical junction to an outer tube 48 of larger diameter which extends out through the hollow stator vane 20, through the blade ring 12 and through the outer casing 10 to a location exterior of the turbine casing, and with a compression spring 50 encompassing the tube 48 and serving as a biasing means forcing the conical junction into tightly seated relation at 52 to the radially outer end portion of the bore 40. The seal so formed at 52 prevents contamination of the bypass flow in the bore 40 by extraneous cooling flow so as to minimize conduction, convection, and radiation errors in the temperature sampling. The reduced diameter end portion 46 containing the thermocouple provides a relatively high heat transfer coefficient and is of sufficient length so as to minimize conduction error in the temperature readings by the interior thermocouple.

The diameter of the aspirating orifice 42 is selected to give the least flow rate which will be adequate to provide the required heat transfer to the thermocouple tip thus assuring temperature measuring accuracy.

From the foregoing it will be apparent that the arrangement according to the invention provides a thermocouple probe temperature measuring system which samples the proper environmental disc cavity region by virtue of the self-aspirating sampling feature provided within the seal housing geometry shown. At the same time, the thermocouple probe system can readily be replaced or checked without disassembly of any of the basic turbine components.

What we claim is:

1. In a turbine having a rotor with adjacent rotor discs thereof defining an interstage cavity, an arrangement for sensing temperature in said cavity comprising:

seal housing structure in said cavity separating the upstream region of said cavity from the downstream region thereof, and having its radially inner facing portions defining, with the radially outer facing portion of the rotor, a fluid leakage path between said upstream and downstream regions;

seal means in said leakage path to limit the degree of leakage therethrough;

means defining a venting passage from an intermediate location along said leakage path to said downstream region; and an assembly in the turbine including means in said passage for sensing the temperature of the fluid flowing through said passage.

2. An arrangement according to claim 1 wherein:

said venting passage comprises interconnecting bores in said seal housing structure.

3. An arrangement according to claim 2 wherein:

said bores includes a radially-directed bore.

4. An arrangement according to claim 3 including:

a probe of said assembly including a series of shield tubes connected with each other in a straight line configuration, and having a temperature sensing element at one end portion thereof, said assembly extending from exteriorly of said turbine, and having said one end portion thereof disposed in said radially directed bore.

5. An arrangement according to claim 4 wherein:

said one end portion is of a reduced diameter relative to the remainder of said tubes and is joined thereto in a conical junction.

6. An arrangement according to claim 5 including:

said conical junction at the junction of said reduced diameter portion with the adjacent tube seats in the radially outer end portion of said radially-directed bore.

7. An arrangement according to claim 6 including:

means biasing said conical junction into a seated position in said bore to form a second seal.

* * * * *